US005785402A

United States Patent [19]

DeLorenzo

[11] Patent Number: 5,785,402

[45] Date of Patent: Jul. 28, 1998

[54] REMOVABLE DRAWER CARTRIDGE

[75] Inventor: Orindo A. DeLorenzo, Mt. Pleasant, Mich.

[73] Assignee: Randell Manufacturing, Inc., Weidman, Mich.

[21] Appl. No.: 747,037

[22] Filed: Nov. 8, 1996

[51] Int. Cl.[6] ..... A47B 88/00

[52] U.S. Cl. ..... 312/350; 312/330.1; 312/246; 312/333

[58] Field of Search ..... 312/242, 245, 312/246, 265.1, 350, 330.1, 333, 223.1, 223.2, 334.1

[56] References Cited

U.S. PATENT DOCUMENTS

| | | | |
|---|---|---|---|
| 4,105,270 | 8/1978 | Bergkamp et al. | 312/330.1 |
| 4,191,436 | 3/1980 | Chenny | 312/333 X |
| 4,457,436 | 7/1984 | Kelley | 312/246 X |
| 4,586,759 | 5/1986 | Wrobee | 312/198 |
| 4,653,818 | 3/1987 | DeBruyn | 312/246 |
| 4,735,470 | 4/1988 | Falk | 312/246 |
| 5,102,210 | 4/1992 | Beals | 312/330.1 |
| 5,262,923 | 11/1993 | Batta et al. | 312/333 X |
| 5,421,647 | 6/1995 | Simons | 312/265.1 |
| 5,495,954 | 3/1996 | Schmit | 312/246 |
| 5,520,452 | 5/1996 | Pattersen et al. | 312/330.1 X |
| 5,571,256 | 11/1996 | Good et al. | 312/223.1 X |
| 5,588,728 | 12/1996 | Eldridge et al. | 312/223.1 X |

*Primary Examiner*—Peter M. Cuomo
*Assistant Examiner*—James O. Hansen
*Attorney, Agent, or Firm*—Young & Basile, P.C.

[57] ABSTRACT

A removable drawer cartridge is installed within a cabinet having a front face, a hollow interior, and an opening defined in the front face. The drawer cartridge comprises a mechanism, removably receivable through the cabinet opening and within the hollow interior, for housing at least one drawer. A mechanism is provided for locating the housing mechanism accurately within the hollow interior. The drawer cartridge further comprises a mechanism for quickly and releasably attaching the housing mechanism to the cabinet.

14 Claims, 3 Drawing Sheets

REMOVABLE DRAWER CARTRIDGE

BACKGROUND OF THE INVENTION

The present invention relates generally to cabinet drawers, and more particularly to a drawer cartridge for housing the drawers which is quickly, easily and releasably mounted within a cabinet.

Conventional cabinets are designed with fixtures therein which locate and hold shelving, drawers and the like. According to the desired application, or for other utilitarian or aesthetic purposes, the fixtures may be of various size and configuration and may be mounted in any of a variety of ways. A few examples of the many possible fixtures include rails, sliding tracks, gusseted shelf brackets, and the like. These fixtures may hold drawers, shelving, and/or any other storage media.

The fixtures mentioned hereinabove are generally permanently mounted to the cabinetry. If they are removable, it is usually rather difficult and time consuming to do so. Sometimes the shelves and/or drawers themselves are permanently mounted to the fixtures. Further, if one did wish to remove all the drawers and shelves, including the fixtures, for cleaning, repair, or the like, one would have to remove a set of locating/support fixtures for each drawer and/or shelf. This adds to the tedium and time intensive labor in removing this type of fixtures.

In addition, when replacing the fixtures in the cabinetry for the drawers/shelves, if all the drawers/shelves are not exactly the same size/shape, and/or if they are not intended to be interchangeable in their replacement locations, there is a high probability that fixtures will be replaced improperly. In such a case, the drawers/shelves will not fit correctly and/or in their correct location, necessitating subsequent removal and replacement of the fixtures. As can be appreciated, this too can be time consuming, frustrating and expensive.

In many applications, removal of storage media such as drawers, shelving and the like and their accompanying fixtures may not be of utmost concern. However, in some areas, it may not only be desirable or important, but critical, such as in the food handling industry and the medical profession. For example, in food processing, storage or preparation, it is nearly impossible to prevent food from falling behind shelves, into the support fixtures and into corners of the cabinetry behind drawers. If left unattended, these food particles will decay and allow the growth of harmful germs and bacteria, thereby risking contamination of new food processed, stored or prepared around the drawers and/or shelves.

Given the drawbacks outlined above of complete removal of drawers, shelves and their accompanying fixtures, it is understandable that many in the food handling industry or medical profession would attempt to clean and/or sterilize the drawers, fixtures and cabinetry without removal of anything other than, perhaps, easily removable drawers or shelving. However, it can be appreciated that, given the high risk of spreading disease, this type of non-thorough cleaning may not be acceptable.

Accordingly, an object of the invention is to provide a drawer/shelf cartridge which completely houses at least one drawer/shelf, needing no drawer/shelf locating/support fixtures within the cabinet. It is a further object of the present invention to provide such a cartridge which is quickly and releasably mountable within a cabinet for easy removal for repair or cleaning. It is yet a further object of the present invention to provide such a cartridge which is quickly, easily and precisely mountable within a cabinet. Yet still further, it is an object of the present invention to provide a cartridge which may be easily retrofit into existing cabinetry.

SUMMARY OF THE INVENTION

The present invention addresses and solves the problems enumerated above while carrying out the above-mentioned objects. The present invention comprises a removable drawer cartridge for installation within a cabinet having a front face, a hollow interior, and an opening defined in the front face. The drawer cartridge comprises means, removably receivable through the cabinet opening and within the hollow interior, for housing at least one drawer, and means for locating the housing means accurately within the hollow interior. The drawer cartridge further comprises means for quickly and releasably attaching the housing means to the cabinet.

BRIEF DESCRIPTION OF THE DRAWINGS

Other objects, features, advantages and applications of the present invention will become apparent to those skilled in the art by reference to the following detailed description and drawings, in which.

DETAILED DESCRIPTION OF THE PREFERRED EMBODIMENTS

Figure 1:
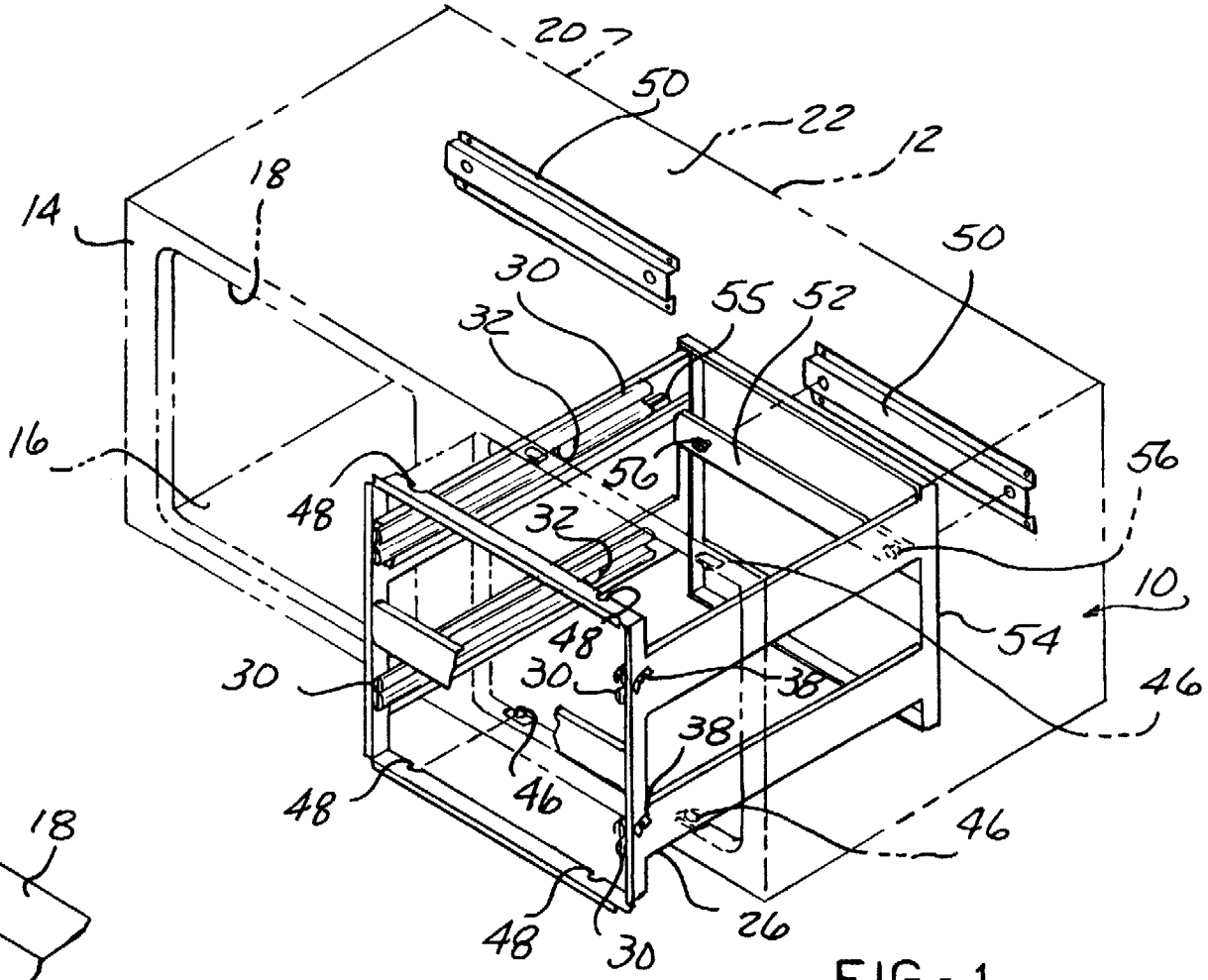
FIG. 1 is an exploded perspective view, partially cutaway, of the outer track assembly of the drawer cartridge of the present invention, showing the mounting surface mounted on the cabinet (shown in phantom) and the retaining bracket disposed on the track assembly.

Referring now to FIG. 1, the removable drawer cartridge of the present invention is designated generally as 10. It is to be understood that, in addition to drawers, the cartridge of the present invention may also be adapted for use with shelves and the like. Drawer cartridge 10 is for installation within a cabinet 12 having a front face 14, a hollow interior 16, an opening 18 defined in the front face 14, and a back wall 20 having an inner surface 22. It is to be understood that the cabinet 12 may be formed in any suitable size and configuration, as desired, and may also be formed from any suitable material. Traditional cabinets are generally formed from wood or wood products, plastics, and/or any suitable metal material.

Figure 3:
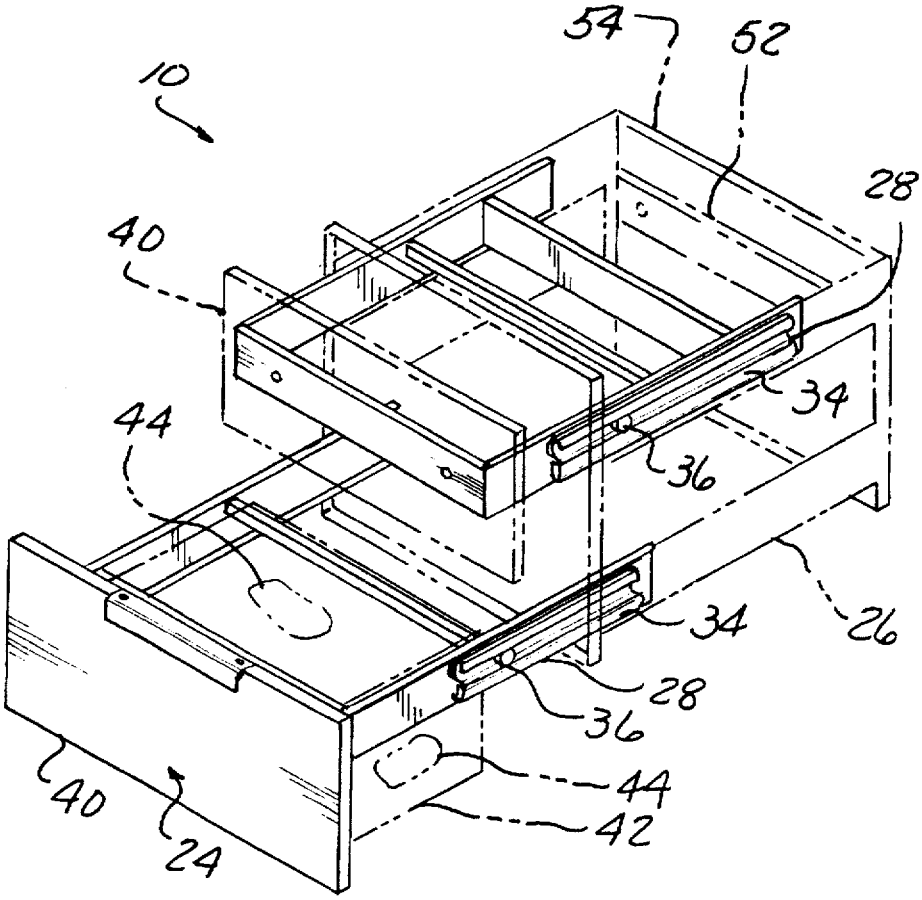
FIG. 3 is a perspective view of the inner track carriage shown slidably received within the outer track assembly (shown in phantom), showing one of the two drawer faces in phantom, and showing in phantom a drop-in storage container with food therein.

The drawer cartridge 10 comprises means, removably receivable through the cabinet opening 18 and within the hollow interior 16, for housing at least one drawer 24. It is to be understood that this housing means may comprise any suitable means, however, in the preferred embodiment, the housing means comprises an outer track assembly 26, the outer track assembly 26 being quickly and releasably attached to the cabinet 12. As best seen in FIG. 3, the housing means may further comprise an inner track carriage 28 slidably receivable within the outer track assembly 26, the inner track carriage 28 adapted to slidably receive at least one drawer 24. The inner track carriage 28 may be assembled to the outer track assembly 26 in any suitable manner, however, in the preferred embodiment, the inner track carriage 28 is slidably assembled to outer track assembly 26 by hand, without the use of tools.

Outer track assembly 26 and inner track carriage 28 may be formed from any suitable material and in any suitable manner so as to carry out the objects and advantages of the present invention. However, in the preferred embodiment, outer track assembly 26 and inner track carriage 28 are formed from a suitably rigid, yet somewhat flexible metal material. Further, outer track assembly 26 is formed with rails 30 and rollers 32; and inner track carriage 28 is formed with slidably mating, complementarily shaped rails 34 and rollers 36. Rails 55 may be included as supporting legs for the outer track assembly frame back surface 54. Further, suitable locking means 38 may be provided for releasably locking drawers 24 within the outer track assembly 26, for preventing drawers 24 from being totally removed accidentally and/or undesirably.

As shown in FIG. 3, any suitable drawer face 40 may be attached to drawer 24, and any suitable drawer interior may be formed. For example, there is shown a removable, drop-in drawer interior 42 having therein any suitable storage items 44, such as food items. It is to be understood that the drawers 24 may be adapted for many other suitable interiors (not shown). Further, although only two drawers 24 are shown, it is to be understood that the outer track assembly 26/inner track carriage 28 may be formed to house any number, shape and size of drawers, as desired and/or necessitated by a particular end use.

Figure 2:
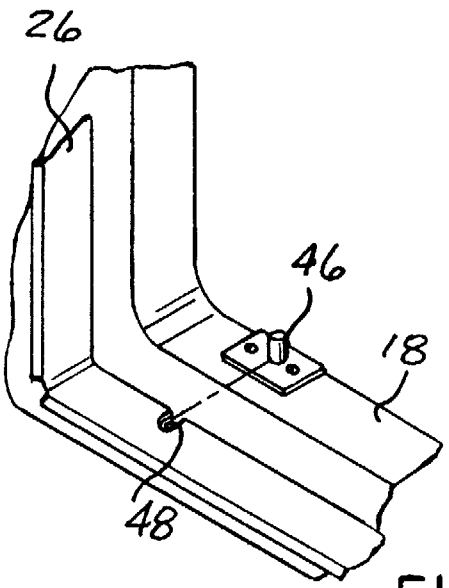
FIG. 2 is an exploded, enlarged, cutaway perspective view of one locating projection and groove.

The drawer cartridge 10 of the present invention may further comprise means for locating the housing means accurately within the hollow interior. It is to be understood that this locating means may be formed in any suitable manner, and from a variety of materials and methods. However, in the preferred embodiment, as best seen in FIG. 2, this locating means comprises at least one projection or pin 46 disposed on one of the cabinet opening 18 and the housing means, and at least one complementarily shaped groove 48 defined in the other of the cabinet opening 18 and the housing means, wherein the projection 46 is removably receivable within the groove 48. In the preferred embodiment, as seen in FIGS. 1 and 2, the projection 46 is disposed on the cabinet opening 18, and the groove 48 is defined in the outer track assembly 26. Although any number of locating means may be provided as desired and/or needed, in the preferred embodiment four mating projections 46 and grooves 48 are provided.

Figure 4:
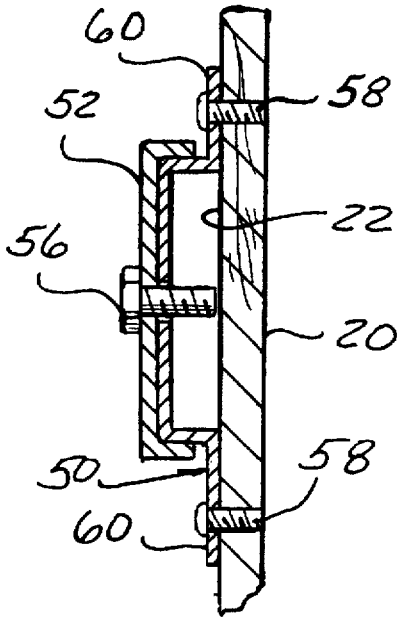
FIG. 4 is an enlarged cross sectional view of the flanged C-shaped channel mounting surface shown attached to a cabinet wall, and the mating C-shaped channel retaining bracket mounted thereto with a quick release hand tightened bolt.
Figure 5:
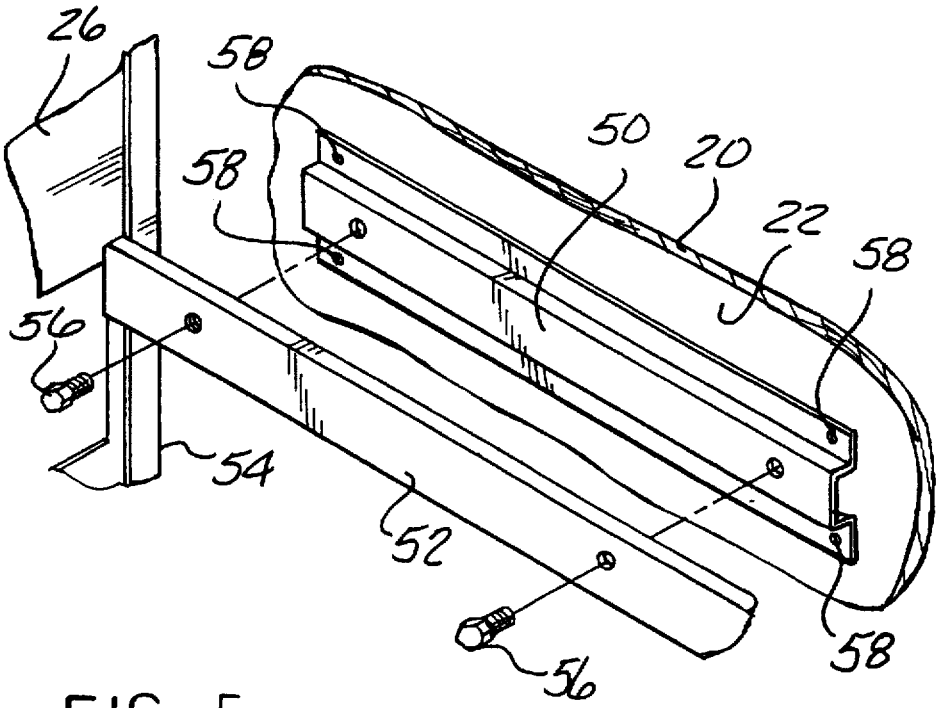
FIG. 5 an enlarged, cutaway, exploded perspective view showing the quick release attachment by two hand tightened bolts.

The drawer cartridge 10 of the present invention may further comprise means for quickly and releasably attaching the housing means to the cabinet 12. It is to be understood that this quick and releasable attaching means may be formed in any suitable manner, and from a variety of materials and methods. However, in the preferred embodiment, as best seen in FIGS. 1, 4 and 5, the quick and releasable attaching means comprises a mounting surface 50 mounted on the back wall inner surface 22, and a complementarily shaped retaining bracket 52 disposed on the outer track assembly frame back surface 54. Mounting surface 50 may be mounted or adhered to back wall inner surface 22 by any suitable means. However, in the preferred embodiment, mounting surface 50 is mounted by use of screws 58.

It is to be further understood that the mounting surface 50 and the retaining bracket 52 may be formed from any suitable material and in any suitable size and configuration. However, in the preferred embodiment, as best seen in FIG. 4, mounting surface 50 is formed as a C-shaped channel having two outwardly extending flanges 60, and the retaining bracket 52 is formed as a mating C-shaped channel. Mounting surface 50 and retaining bracket 52 are formed from a suitable metal material.

The quick and releasable attaching means further comprises a fastener attaching the retaining bracket 52 to the mounting surface 50. It is to be understood that this fastener may comprise any suitable fastener which is quickly and easily attached and detached, preferably by hand and without the use of tools. Some exemplary fasteners include snap-in plunger style catches, swell latches (a device where the latch turns causes a rubber bushing to swell into a hole and lock into place), and/or any fractional turn locking mechanisms. In the preferred embodiment, this fastener comprises a quick release hand tightened bolt 56.

Figure 6:
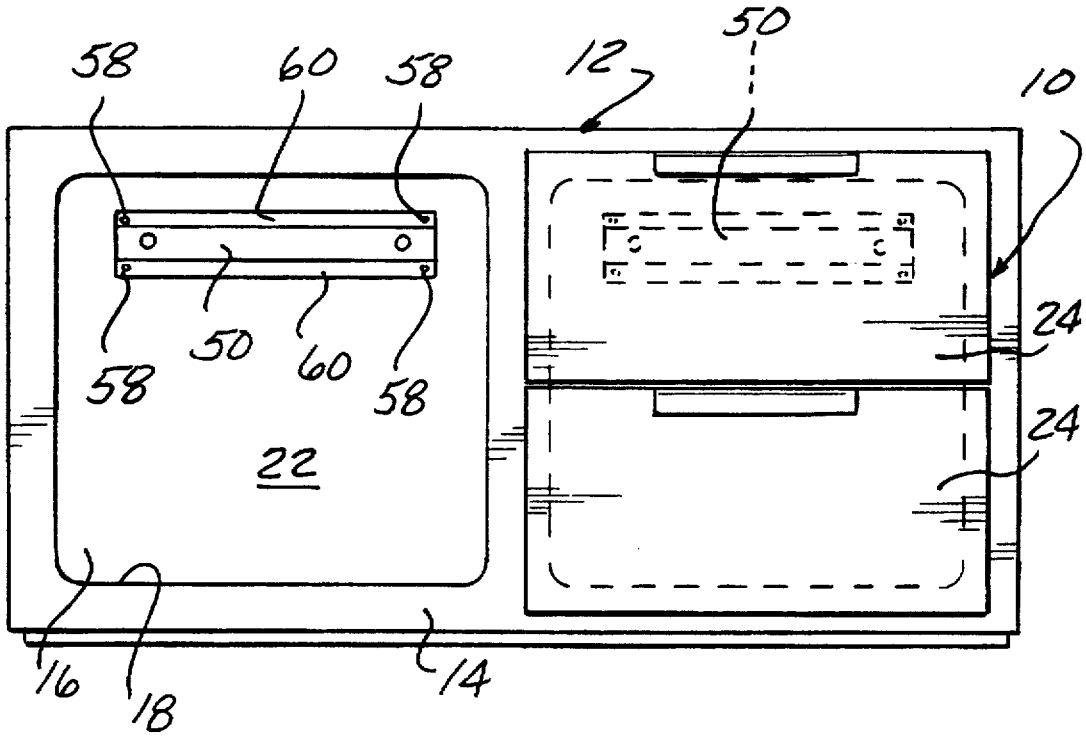
FIG. 6 is a front view of a cabinet having two openings, one opening showing the hollow interior with the mounting surface mounted to the cabinet back wall inner surface, the other opening shown in hidden line and having therein a drawer cartridge according to the present invention, the drawer cartridge housing two drawers.

Referring now to FIG. 6, an installed drawer cartridge 10 of the present invention housing two drawers 24 is shown on the right side of the Figure. As can be seen, the installed invention from the outside looks similar to conventional drawers. The mounting surface 50 is shown in hidden line on the right side, while it is in full view on the left side of the cabinet 12, which is shown with no drawer cartridge 10.

As can be appreciated from the above detailed description, the drawer cartridge 10 may be easily retrofitted into a pre-existing cabinet, as well as originally fit with a dedicated cabinet 12.

The drawer cartridge 10 of the present invention achieves the objects and advantages set forth in more detail hereinabove. The drawer cartridge 10, including the outer track assembly 26 and inner track carriage 28 housing drawer 24 is quickly and easily removed from cabinet 12 by simply untightening hand tightened bolts 56. When the drawer cartridge 10 is removed, the cabinet 12 appears as in the left side of FIG. 6, thereby making cleaning and/or sterilizing of the interior 16 of cabinet 12 quick and easy. Further, once the drawer cartridge 10 is removed and its components slidably disengaged, it too is quickly and easily cleaned and/or sterilized. Once this process is complete, it is a simple matter to locate the proper positioning of cartridge 10 using projections 46 and grooves 48, and the cartridge 10 is quickly mounted via the hand tightened bolts 56. In a matter of minutes, the cabinet 12 can go from that as depicted on the left side of FIG. 6, to that as depicted on the right side of FIG. 6.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A cabinet having a front face, a hollow interior, a back wall having an inner surface, an opening defined in the front face, and a removable drawer cartridge, the drawer cartridge comprising:

means, removably receivable through the cabinet opening and within the hollow interior, for housing at least one drawer, wherein the housing means comprises:

an outer track assembly including a frame having a back surface, the outer track assembly being quickly and releasably attached to the cabinet; and an inner track carriage slidably receivable within the outer track assembly, the inner track carriage adapted to slidably receive the at least one drawer;

means for locating the housing means accurately within the hollow interior; and means for quickly and releasably attaching the housing means to the cabinet, wherein the quick and releasable attaching means comprises:

a mounting surface mounted on the back wall inner surface;

a complementarily shaped retaining bracket disposed on the frame back surface; and a fastener for attaching the retaining bracket to the mounting surface, wherein the fastener is a quick release hand tightened bolt.

2. The removable drawer cartridge as defined in claim 1 wherein the locating means comprises:

at least one projection disposed on one of the cabinet opening and the housing means; and at least one complementarily shaped groove defined in the other of the cabinet opening and the housing means, wherein the projection is removably receivable within the groove.

3. The removable drawer cartridge as defined in claim 2 herein the projection is disposed on the cabinet opening, and wherein the groove is defined in the housing means.

4. The removable drawer cartridge as defined in claim 1 wherein the quick and releasable attaching means is performed by hand.

5. The removable drawer cartridge as defined in claim 1 wherein the drawer cartridge is easily retrofitted into a pre-existing cabinet.

6. A cabinet having a front face, a hollow interior, a back wall having an inner surface, an opening defined in the front face, and a removable drawer cartridge, the drawer cartridge comprising:

means, removably receivable through the cabinet opening and within the hollow interior, for housing at least one drawer, wherein the housing means comprises:

an outer track assembly including a frame having a back surface, the outer track assembly being quickly and releasably attached to the cabinet; and an inner track carriage slidably receivable within the outer track assembly, the inner track carriage adapted to slidably receive the at least one drawer;

means for locating the housing means accurately within the hollow interior; and means for quickly and releasably attaching the housing means to the cabinet, wherein the quick and releasable attaching means comprises:

a mounting surface mounted on the back wall inner surface, wherein the mounting surface is formed as a flanged C-shaped channel;

a complementarily shaped retaining bracket disposed on the frame back surface, the retaining bracket being formed as a mating C-shaped channel; and a fastener for attaching the retaining bracket to the mounting surface.

7. The removable drawer cartridge as defined in claim 6 wherein the locating means comprises:

at least one projection disposed on one of the cabinet opening and the housing means; and at least one complementarily shaped groove defined in the other of the cabinet opening and the housing means, wherein the projection is removably receivable within the groove.

8. The removable drawer cartridge as defined in claim 7 wherein the projection is disposed on the cabinet opening, and wherein the groove is defined in the housing means.

9. The removable drawer cartridge as defined in claim 6 wherein the quick and releasable attaching means is performed by hand.

10. The removable drawer cartridge as defined in claim 6 wherein the drawer cartridge is easily retrofitted into a pre-existing cabinet.

11. A cabinet having a front face, a hollow interior, a back wall having an inner surface, an opening defined in the front face, and a removable drawer cartridge, the drawer cartridge comprising:

means, removably receivable through the cabinet opening and within the hollow interior, for housing at least one drawer, wherein the housing means comprises:

an outer track assembly having a frame with a back surface, the outer track assembly being quickly and releasably attached to the cabinet; and an inner track carriage slidably receivable within the outer track assembly, the inner track carriage adapted to slidably receive the at least one drawer;

means for locating the housing means accurately within the hollow interior, wherein the locating means comprises:

at least one projection disposed on one of the cabinet opening and the housing means; and at least one complementarily shaped groove defined in the other of the cabinet opening and the housing means, wherein the projection is removably receivable within the groove; and means for quickly and releasably attaching the housing means to the cabinet, wherein the quick and releasable attaching means comprises:

a mounting surface mounted on the back wall inner surface;

a complementarily shaped retaining bracket disposed on the frame back surface; and a fastener for attaching the retaining bracket to the mounting surface.

12. The removable drawer cartridge as defined in claim 11 wherein the fastener is a quick release hand tightened bolt.

13. The removable drawer cartridge as defined in claim 11 wherein the mounting surface and the retaining bracket are formed as mating C-shaped channels.

14. The removable drawer cartridge as defined in claim 11 wherein the drawer cartridge is easily retrofitted into a pre-existing cabinet.

* * * * *